US009862069B2

(12) United States Patent
Schmitz

(10) Patent No.: US 9,862,069 B2
(45) Date of Patent: Jan. 9, 2018

(54) METHOD FOR PRODUCING GROOVES ON A CAMSHAFT

(71) Applicant: Thielenhaus Technologies GmbH, Wuppertal (DE)

(72) Inventor: Thomas Schmitz, Wermelskirchen (DE)

(73) Assignee: THIELENHAUS TECHNOLOGIES GMBH, Wuppertal (DE)

( * ) Notice: Subject to any disclaimer, the term of this patent is extended or adjusted under 35 U.S.C. 154(b) by 285 days.

(21) Appl. No.: 14/946,102

(22) Filed: Nov. 19, 2015

(65) Prior Publication Data

US 2016/0153540 A1 Jun. 2, 2016

(30) Foreign Application Priority Data

Nov. 27, 2014 (DE) ..... 10 2014 117 398

(51) Int. Cl.
*B24B 35/00* (2006.01)
*B24B 19/12* (2006.01)
*B24B 21/00* (2006.01)

(52) U.S. Cl.
CPC ..... *B24B 35/00* (2013.01); *B24B 19/12* (2013.01); *B24B 21/006* (2013.01)

(58) Field of Classification Search
CPC ..... B24B 35/00; B24B 19/12; B24B 19/02; B24B 19/002; B24B 19/028; B24B 19/06; B24B 21/006; B24B 21/02; B24B 8/04; B24B 8/047; B24B 8/42; F16C 17/026; F16C 17/045; F16C 17/102; F16C 3/00; F16C 3/06; F16C 3/14; F16C 3/16; F16C 33/1065; F16C 2223/02; F16C 2223/06; Y10T 29/49283; Y10T 29/49293; Y10T 29/49647; Y10T 29/49702; Y10T 29/49707
USPC ..... 384/291, 292; 451/49; 492/30, 31, 33, 492/34, 35; 29/888.1, 888.08, 898.04, 29/898.042, 898.1, 898.13
See application file for complete search history.

(56) References Cited

U.S. PATENT DOCUMENTS 1,472,295 A * 10/1923 Donnelly ..... B24B 33/00 29/90.01
1,511,842 A * 10/1924 Schmidt ..... B24B 19/028 241/293

(Continued)

*Primary Examiner* — Jason L Vaughan
(74) *Attorney, Agent, or Firm* — Johnson, Marcou & Isaacs, LLC; Jennifer S. Stachniak

(57) ABSTRACT

In a method for end processing a surface of a shaft-like workpiece, the following steps are performed in the following series, and the workpiece rotates about an axis of rotation:
a) finishing the surface with a first finishing tool,
b) machining the surface with a scoring tool, whereby the scoring tool produces at least one groove running in a circumferential direction, whereby the at least one groove produces 3 to 12 profiled gorges on a reference segment which reference segment has a length that is predetermined by a measuring method for roughness determination and which is extending on the surface parallel to the axis of rotation, each of said profiled gorges having a depth and width, whereby the ratio of the depth and width of each profiled gorge is greater than 2 and a distance between adjacent profiled gorges is substantially the same,
c) machining the surface with the first finishing tool or a second finishing tool.

9 Claims, 1 Drawing Sheet

(56) References Cited

U.S. PATENT DOCUMENTS 2,869,295 A * 1/1959 Naumann ..... B24B 19/028 451/49
4,834,400 A * 5/1989 Lebeck ..... F16C 29/02 277/399
4,856,235 A * 8/1989 Haynie ..... B24B 19/028 451/49
4,973,068 A * 11/1990 Lebeck ..... F16C 29/02 277/399
5,107,626 A * 4/1992 Mucci ..... B24B 19/028 451/28
5,190,002 A * 3/1993 Wietig ..... F01L 3/00 123/188.11
5,643,054 A * 7/1997 Bach ..... B24B 19/028 384/490
5,722,878 A * 3/1998 Phillips ..... B24B 19/12 451/163
5,931,038 A * 8/1999 Higashi ..... B23P 9/02 123/193.2
5,967,672 A * 10/1999 Akamatsu ..... F16C 17/026 384/516
6,059,460 A * 5/2000 Ono ..... F16C 9/00 384/283
6,082,904 A * 7/2000 Ono ..... F16C 9/00 384/283
6,089,756 A * 7/2000 Ono ..... F16C 9/00 384/283
6,739,238 B2 * 5/2004 Ushijima ..... F02F 1/20 92/158
6,793,560 B2 * 9/2004 Weigmann ..... B24B 19/028 408/158
6,802,650 B2 * 10/2004 Yasuda ..... F16C 3/08 384/276
7,134,939 B2 * 11/2006 Shamshidov ..... B24B 19/028 451/36
7,140,812 B2 * 11/2006 Bryan ..... B29C 59/022 29/557
7,226,211 B2 * 6/2007 Furuta ..... B24B 5/22 384/100
7,484,890 B2 * 2/2009 Ikeda ..... F16C 13/006 29/898.06
7,510,462 B2 * 3/2009 Bryan ..... B23B 5/00 125/13.01
7,744,444 B2 * 6/2010 Mandel ..... B24B 37/02 451/11
7,766,727 B2 * 8/2010 Mandel ..... B24B 5/04 29/898.1
7,832,935 B2 * 11/2010 Hou ..... F16C 17/026 216/50
7,918,713 B2 * 4/2011 Mandel ..... B24B 37/00 451/37
8,412,080 B2 * 4/2013 Maeda ..... B21H 7/18 29/895.3
8,858,081 B2 * 10/2014 Hikita ..... F16C 33/1065 384/129
9,032,597 B2 * 5/2015 Zhmud ..... C10M 125/22 29/90.01
2005/0155451 A1 * 7/2005 Abeln ..... F16C 9/04 74/579 R
2008/0166950 A1 * 7/2008 Mandel ..... B24B 37/00 451/36
2008/0166955 A1 * 7/2008 Mandel ..... B24B 37/04 451/164
2013/0182981 A1 * 7/2013 Ishigo ..... F16C 9/02 384/397
2014/0064645 A1 * 3/2014 Kawashima ..... F16C 9/04 384/288
2016/0273576 A1 * 9/2016 Schreiber ..... B23H 3/00

* cited by examiner

METHOD FOR PRODUCING GROOVES ON A CAMSHAFT

CROSS-REFERENCE TO RELATED APPLICATIONS

The instant application claims the priority date of Nov. 27, 2014, the filing date of the German patent application DE 102014117398.8.

BACKGROUND OF THE INVENTION

The present invention relates to a method for end processing of a surface of a shaft-like workpiece.

The operating characteristics, in particular of camshafts, and the ability to distribute a lubricant on the surface of the camshaft depend critically on the surface structure. One measurement of the surface structure is roughness. In this connection, it is desirable that the surface, in particular one of the bearing points of the camshaft, have individual, deep grooves, whereby the region between the grooves is as "smooth" as possible. In order to characterize the roughness profile of a surface determined with known methods, it is known to transfer a roughness profile determined on a measuring length to an Abbott Curve, whereby in case of a S-shaped course of the Abbott Curve, parameters can be determined from the Abbott Curve, such as core roughness depth $R_k$, reduced peak height $R_{pk}$, and reduced valley depth $R_{vk}$. In the frame of this nomenclature, it already is possible that a relatively small reduced peak height $R_{pk}$ is achieved with a relatively greatly reduced valley depth $R_{vk}$, which, in turn, lies in the range of the core roughness depth $R_k$. For achieving such a surface, it is known to machine the surface first with a relatively coarse tool and subsequently, to polish with a relatively fine-grained tool.

The problem associated with the known methods is that greatly enhanced reduced valley depth $R_{vk}$ relative to the core roughness depth $R_k$ by producing deeper grooves cannot be achieved in any reproducible manner.

SUMMARY OF THE INVENTION

It therefore is an object of the present invention to solve at least partially the problems related to the state of the art and in particular, to provide a method for end processing a surface of a shaft-like workpiece, by means of which a surface with a smaller reduced peak height $R_{pk}$ and a greatly enhanced reduced valley depth $R_{vk}$ relative to the core roughness depth $R_k$ can be reliably produced.

This object is solved by a method with the features of the independent claim. Advantageous embodiments of the method are provided in the dependent claims and in the description, whereby features of the advantageous embodiments can be combined with one another in a technologically sensible manner.

These objects are solved in particular by a method for end processing a surface of a shaft-like workpiece, in which the following steps are performed in the sequence provided, whereby the workpiece rotates about an axis of rotation:

a) finishing the surface with a first finishing tool, b) machining the surface with a scoring tool, whereby the scoring tool produces at least one groove running in a circumferential direction, whereby the at least one groove produces 3 to 12 profiled gorges, preferably 4 to 8, and more preferably 5 profiled gorges, on a reference segment which reference segment has a length that is predetermined by a measuring method for roughness determination and which is extending on the surface parallel to the axis of rotation, each of which profiled gorges has a depth and width, whereby the ratio of the depth and width of each profiled gorge is greater than 2 and the distance between adjacent profiled gorges is substantially the same, c) machining the surface with the first finishing tool or a second finishing tool.

In particular, with machining steps a) and c), the first finishing tool or the second finishing tool moves in an oscillating motion parallel to the axis of rotation of the camshaft. Such finishing is also known as micro-finishing.

The reference segment is, in particular, a line on the surface of the workpiece that runs parallel to the axis of rotation, along which the roughness of the workpiece is measured after end machining. The length of the reference segment corresponds to the length of the measurement segment that was considered for determination of the roughness, in particular, for determination of the Abbott Curve, and which amounts to a multiple, in particular, five-times that of a single measurement segment, whereby the length of the single measurement segment therefore corresponds numerically to the threshold wavelength of the profile filter $\lambda_c$, with which the roughness profile is deduced from the primary profile. Therefore, the roughness profile of the workpiece is determined along the reference segment. Methods for determining the roughness profile are known from the state of the art. In particular, the determination methods, the evaluation methods, and the corresponding parameters of the roughness determination are defined in the standards for Geometric Product Specifications (GPS). In particular, reference is made to the following standard specifications: DIN EN ISO 3274, DIN EN ISO 4287, DIN EN ISO 4288, as well as Parts 1 through 3 of the DIN EN ISO 13565, in particular in the version in which they are provided in the "DIN-Taschenbuch 488" (ISBN 978-3-410-23275-9). An overview regarding the roughness measurement and determination of the roughness parameter, in addition, is provided in the lecture notes of the University of Stuttgart "Oberflächenbeurteilung, Rauheitsmessung, allgemeines Praktikum Maschinenbau and Hauptfachversuch, Universität Stuttgart, Institut für Maschinenelemente, Prof. Dr.-Ing. habil. Werner Haas".

With the machining in step b), the scoring tool produces a plurality of grooves running in the circumferential direction. Upon cutting with the reference segment, these grooves produce profiled valleys, which are determined with the roughness measurement along the reference segment. According to the present invention, 3 through 12 profiled valleys on the reference segment have a ratio of depth and width of greater than 2 and the same distance between adjacent profiled valleys on the reference segment. These profiled valleys are designated as profiled gorges.

The profiled gorges according to the present invention thus correspond with the 3 through 12, preferably 4 through 8, and more preferably exactly 5 deepest profiled valleys in the roughness profile determined on the reference segment. These deepest profiled valleys, designated as profiled gorges, must be arranged in the roughness profile with the substantially same spacing to one another and have the inventive ratio of depth to width.

In other words, the inventive profiled gorges, in particular the profiled valleys in the roughness profile, are those whose depth is substantially greater than the depth of the remaining profiled valleys in the roughness profile, in particular, twice as deep, preferably three-times as deep as the remaining profiled valleys. In particular, on the reference segment, between the inventive profiled gorges, at least 50 (irregularly distributed) profiled valleys are formed, whereby an average depth of all (including the profiled gorges) profiled valleys of the roughness profile can be considered in this connection as a reference for the relatively large depth of the inventive profiled gorges.

The width of a profiled gorge according to the present invention is the width of the corresponding profiled valley in the roughness profile. Preferably, the ratio of depth and width of each profiled gorge according to the present invention is greater than 3, preferably greater than 4, whereby the ratio is preferably at 10 at the most, and more preferably, is 7 at the most. On technical grounds, a profiled valley with a ratio of greater than 10 normally cannot be manufactured.

The length of the reference segment is preferably 40 mm at the most, preferably 4 mm at the most. The length of the reference segment is preferably at least 0.4 mm. Accordingly, the uniform distance between adjacent profiled gorges is in a range of millimeters, tenths of a millimeter or hundredths of a millimeter. Accordingly, the width of the profiled gorges lies in a range of approximately a hundred micrometers, 10 micrometers or one micrometer. The depth of the profiled gorges therefore is correspondingly larger than twice the width. The length of the reference segment corresponds in particular to the standard DIN EN ISO 4288 depending on the roughness of the measurement segment to be chosen, whereby the measurement segment is five-times as large as a single measurement segment, which in turn, numerically has the same size as the threshold wavelength $\lambda_c$ for the roughness profile filter.

With the substantially same distance between adjacent profiled gorges, it is intended that the distances of respective, adjacent profiled gorges according to the present invention deviate not more than 20% from the average value of all distances of adjacent profiled gorges according to the present invention.

The cutting edges of the scoring tool used for producing the grooves, in particular formed as a grain or as wedge-shaped cutting edges formed on the grain, are pressed in step b) in particular with a predetermined force onto the surface of the workpiece to be machined. In this connection, the cutting edges produce a groove by chipping removal and/or deformation of the surface. The accumulation resulting from this process formed on the lateral edges of the groove is subsequently reduced in its height or is even completely removed by the machining step c).

Under the term shaft-like workpieces, in particular, the terms crankshafts, camshafts, and drive shafts should be understood. For producing a groove or grooves, the scoring tool has at least one cutting edge, formed in particular on a grain. The cutting edge in particular is formed on a grain bonded in a bonding agent. The cutting edge, however, also can be formed by alternative means, for example, a diamond tip, for producing the furrow-shaped groove or grooves. The scoring tool can in particular have a cutting edge or blade or multiple cutting edges arranged with spacing relative to one another.

In step c), the reduced peak height $R_{pk}$ is reduced by finishing, without the reduced valley depth $R_{vk}$ being substantially affected, whereby the core roughness depth $R_k$ is only slightly changed relative to the effective value after the machining in step b). Step c) serves to remove the accumulation on the grooves.

By means of the method according to the present invention, a surface can be produced, whose roughness profile along the reference segment has an S-shaped course in an Abbott Curve, whereby the reduced peak height $R_{pk}$ is relatively minimal and the reduced valley depth $R_{vk}$ is greater than the core roughness depth $R_k$. For determining the parameters that are ascertainable from an Abbott Curve, reference is made in particular to DIN EN IS) 13565-2.

The methods described next can be performed when the scoring tool includes multiple cutting edges or blades arranged with spacing to one another that corresponds to the distance between the profiled gorges on a length corresponding to the length of the reference segment.

In order to produce grooves that produce the profiled gorges on the reference segment which grooves run in the circumferential direction of the surface of the workpiece to be machined, it is provided in particular that the scoring tool does not move parallel to the axis of rotation during rotation of the workpiece in step b). While in machining steps a) and c), the first finishing tool or the second finishing tool oscillates parallel to the axis of rotation, in step b), the scoring tool is fixed at its position.

Alternatively, it can be provided that also in step b), the scoring tool moves in an oscillating manner parallel to the axis of rotation, whereby in step b), the workpiece completes at least one complete rotation and the scoring tool completes at least one complete oscillation motion parallel to the axis of rotation. This has the result that on the surface of the workpiece, grooves are formed, which also have an extension component in the direction of the axis of rotation and eventually cut each other in a reciprocating manner. Thus, a distribution of the lubricating agent on the surface via the grooves also occurs parallel to the axis of rotation of the workpiece.

In this connection, it can be provided that the rotation of the workpiece and the motion of the scoring tool in step b) are synchronized, such that after a rotation of the workpiece about 360°, the scoring tool has performed exactly one or a number of multiple complete oscillation movements. Performing the method in this manner has the result that self-terminating grooves are formed on the circumferential surface of the tool, so that the lubricating agent can be distributed in the grooves in a direction parallel to the axis of rotation. In this connection, it is particularly preferable that an amplitude of the oscillation of the scoring tool in step b) in the direction of the axis of rotation is smaller than the distance of two adjacent cutting edges formed for producing of the grooves.

In order to enable production of especially deep grooves and therewith, deep profiled gorges, it can be provided that a height of the cutting edge of the scoring tool in the direction of the surface of the workpiece is more than twice as great as its extension parallel to the axis of rotation. Preferably, the extension of each cutting edge parallel to the axis of rotation is 100 μm (micrometers) at the most, preferably 50 μm at the most, and even more preferably, 10 μm at the most, whereby if necessary, the spacing between the cutting edges has a size depending on the length of the reference segment and the number of profiled gorges. The extension of each cutting edge parallel to the axis of rotation amounts in particular to at least 1 μm.

Multiple profiled gorges along the reference segment can be produced, however, also by means of only one cutting edge formed on the scoring tool on a length that corresponds to the length of the reference segment, when in step b), the workpiece performs a number of complete rotations that corresponds to the number of the profiled grooves and the scoring tool, in the meantime, performs a linear motion parallel to the axis of rotation that corresponds to the length of the reference segment. In this manner, the cutting edge cuts the reference segment formed on the circumferential surface so many times corresponding to the inventive number of the profiled gorges, whereby on the surface of the workpiece over the length of the reference segment, exactly one screw-shaped groove is produced.

In one embodiment of the invention, it is provided that the scoring tool is an abrasive belt, which produces the at least one groove by at least one, single, relatively large abrasive grain. The relatively large abrasive grains have an extension parallel to the axis of rotation as described above, which also can be considered as the grain size.

In this connection, it can be provided that the at least one abrasive grain (that forms the cutting edge) that produces the groove or grooves is at least twice as large in its extension parallel to the axis of rotation, preferably at least four times as large as the remaining abrasive grains of the abrasive belt.

Alternatively, it can be provided that the scoring tool is a finishing stone, which produces the groove or grooves by means of at least one projection (forming the cutting edge) or by means of defined projections arranged with a spacing from one another that corresponds with the distance between the profiled gorges.

In a further alternative embodiment, it is provided that the scoring tool is a structural fibrous web, which produces the groove or grooves by means of an abrasive grain or by means of multiple abrasive grains, which are arranged on the fibers of the structural fibrous web parallel to the axis of rotation with a spacing from one another that corresponds with the distance between the profiled gorges. The abrasive grain can be arranged in this manner individually on the fibers.

BRIEF DESCRIPTION OF THE DRAWINGS

In the following the invention is described with reference to the drawings, which only depict the invention schematically. The dimensions are only for a better understanding of the invention. The figures show.

DETAILED DESCRIPTION OF THE PREFERRED EMBODIMENTS

Figure 1:
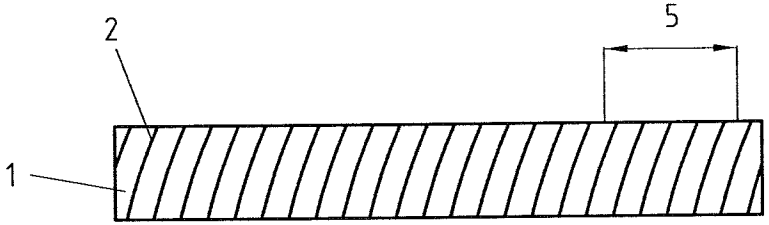
FIG. 1: an end processed workpiece.

The workpiece in FIG. 1 was end processed in such a matter, that only one single groove 2 was produced on the surface of the workpiece, which extends in a screw-shaped manner around the workpiece.

A reference segment 5 extends parallel to the rotation axis of the workpiece on the surface of the workpiece. The single groove 2 cuts the reference segment 5 five times.

Figure 2:
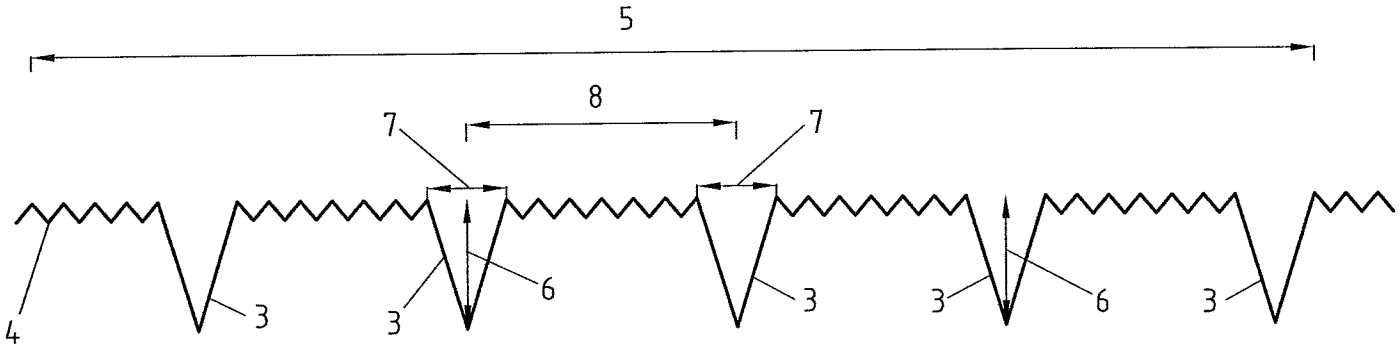
FIG. 2: a roughness profile along a reference segment.

The roughness profile of the reference segment 5 is depicted in FIG. 2. As can be seen the single groove 2 has produced five profile gorges 3 on the reference segment 5. Between two adjacent profiled gorges 3 multiple profile valleys 4 are formed. Each profiled gorge 3 has a depth 6 and a width 7. The radius of the depths and widths of each profiled gorge is greater than two. Furthermore, the distance 8 between two adjacent profiled gorges 3 is substantially the same for all profiled gorges 3.

The specification incorporates by reference the disclosure of DE 102014117398.8, filed Nov. 27, 2014.

The present invention is, of course, in no way restricted to the specific disclosure of the specification and drawings, but also encompasses any modifications within the scope of the appended claims.

The invention claimed is:

1. A method for end processing a surface of a shaft-like workpiece, in which the following steps are performed in the sequence provided, whereby the workpiece rotates about an axis of rotation:

a) finishing the surface with a first finishing tool, b) machining the surface with a scoring tool, whereby the scoring tool produces at least one groove running in a circumferential direction, whereby the at least one groove produces 3 to 12 profiled gorges on a reference segment which reference segment has a length that is predetermined by a measuring method for roughness determination and which is extending on the surface parallel to the axis of rotation, each of said profiled gorges having a depth and width, whereby the ratio of the depth and width of each profiled gorge is greater than 2 and a distance between adjacent profiled gorges is substantially the same, c) machining the surface with the first finishing tool or a second finishing tool.

2. The method according to claim 1, wherein the scoring tool does not move parallel to the axis of rotation during the rotation of the workpiece in step b).

3. The method according to claim 1, wherein in step b), the workpiece executes at least one complete rotation and the scoring tool executes at least one complete oscillation movement parallel to the axis of rotation.

4. The method according to claim 3, wherein rotation of the workpiece and movement of the scoring tool in step b) is synchronized, such that after a rotation of the workpiece about 360°, the scoring tool has executed exactly one or a plurality of multiple, complete oscillation movements.

5. The method according to claim 1, wherein in step b), the workpiece performs a number of complete rotations that corresponds to the number of profiled gorges and during the rotation of the workpiece, the scoring tool executes a linear movement corresponding to the length of the reference segment parallel to the axis of rotation.

6. The method according to claim 1, wherein the scoring tool is an abrasive belt which produces the at least one groove by means of at least one large abrasive grain.

7. The method according to claim 6, wherein the at least one abrasive grain that produces the groove in its extension parallel to the axis of rotation is at least twice as large as the remaining abrasive grains of the abrasive belt.

8. The method according to claim 1, wherein the scoring tool is a finishing stone, which produces the grooves by means of at least one projection or by means of defined projections arranged with a spacing relative to one another that corresponds to the distance between the profiled gorges.

9. The method according to claim 1, wherein the scoring tool is a structural fibrous web, which produces at least one the groove by means of at least one abrasive grain or by means of multiple abrasive grains, wherein said abrasive grains are arranged with a spacing relative to one another that corresponds with the distance between the profiled gorges parallel to the axis of rotation on the fibers of the structural non-woven fabric.

* * * * *